US006499468B1

(12) United States Patent
Ferraro et al.

(10) Patent No.: US 6,499,468 B1
(45) Date of Patent: Dec. 31, 2002

(54) FUEL INJECTION VALVE FOR INTERNAL COMBUSTION ENGINES

(75) Inventors: Giovanni Ferraro, Ludwigsburg (DE); Hansjoerg Egeler, Fellbach (DE); Klaus Ellwanger, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,406

(22) PCT Filed: Aug. 18, 2000

(86) PCT No.: PCT/DE00/02817

§ 371 (c)(1),
(2), (4) Date: Jul. 27, 2001

(87) PCT Pub. No.: WO01/16480

PCT Pub. Date: Mar. 8, 2001

(30) Foreign Application Priority Data

Aug. 28, 1999 (DE) ..... 199 41 054

(51) Int. Cl.[7] ..... F02M 37/04
(52) U.S. Cl. ..... 123/470; 123/509
(58) Field of Search ..... 123/470, 509, 123/456, 469, 468, 472

(56) References Cited

U.S. PATENT DOCUMENTS 2,897,800 A * 8/1959 Haas ..... 123/470
4,066,213 A * 1/1978 Stampe ..... 239/533.3
4,589,596 A * 5/1986 Stumpp et al. ..... 239/397.5
6,009,856 A * 1/2000 Smith, III et al. ..... 123/470
6,116,218 A * 9/2000 Sato et al. ..... 123/470
6,178,950 B1 * 1/2001 Stockner et al. ..... 123/470
6,186,123 B1 * 2/2001 Maier et al. ..... 123/470
6,192,870 B1 * 2/2001 Lambeth ..... 123/510

FOREIGN PATENT DOCUMENTS

DE 3908796 * 12/1989
GB 447 237 * 5/1936
GB 764 877 * 1/1957

* cited by examiner

*Primary Examiner*—Carl S. Miller
(74) *Attorney, Agent, or Firm*—Ronald E. Greigg

(57) ABSTRACT

A fuel injection valve for internal combustion engines, having an associated valve body, wherein the valve body is inserted into the receiving bore of the housing of an internal combustion engine and—by means of a clamping element, which is screwed into an internal thread embodied at the end of the receiving bore remote from the combustion chamber, and a support element disposed in an annular groove—is clamped with an annular shoulder embodied on the valve body against a contact surface embodied in the bore. The inner circumference surface of the clamping element and the outer circumference of the support element are conically embodied so that the axial movement of the clamping element when it is screwed in, exerts a radial force on the support element as a result of which it is pressed with its cylindrical inner circumference surface into the annular groove and as a result, a high axial force can be transmitted to the valve body without high surface pressures occurring as a result.

20 Claims, 3 Drawing Sheets

Figure 1:
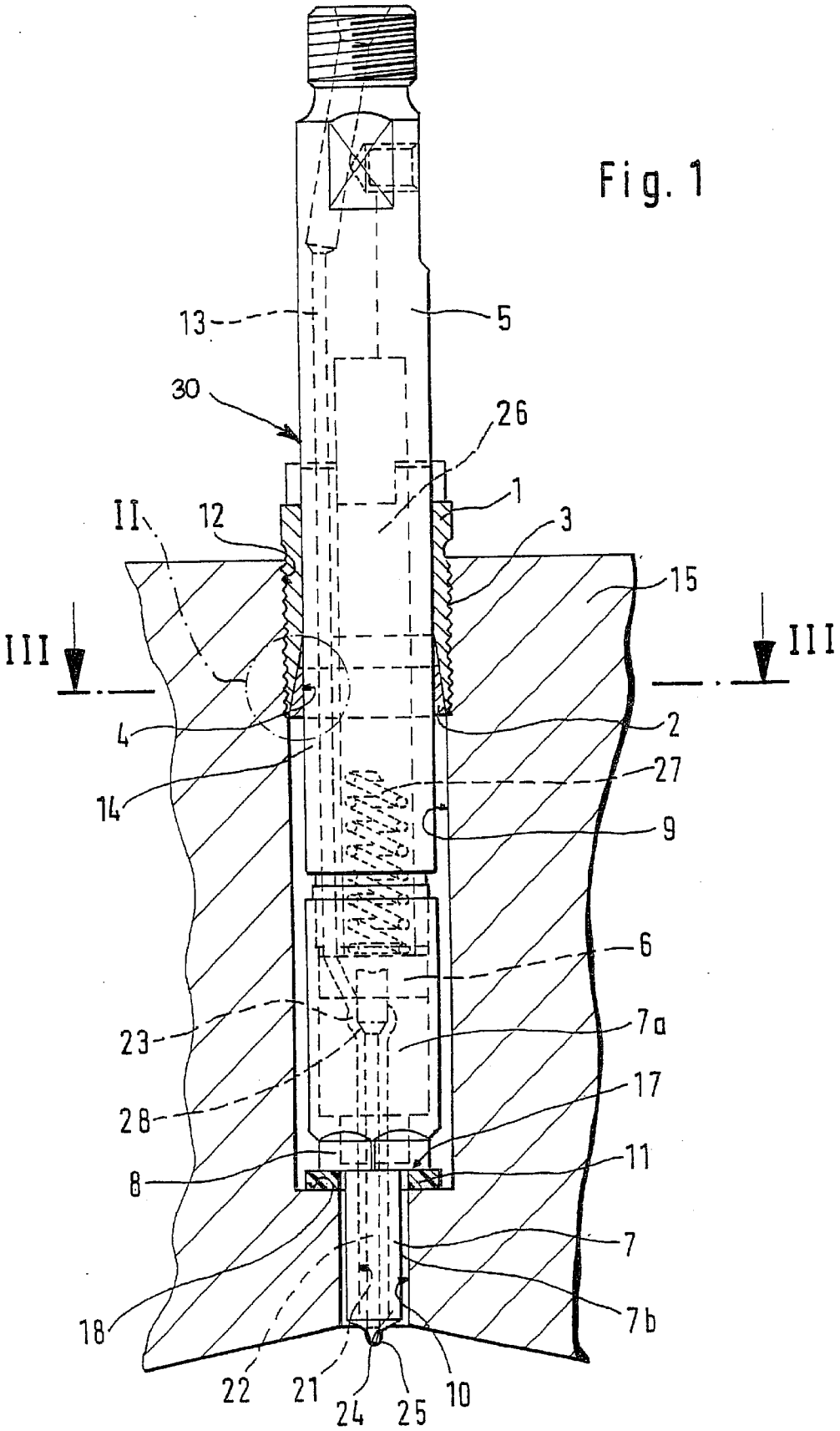

13
5
30
26
1
II
12
3
15
III
III
4
2
27
14
9
6
23
7a
28
17
8
11
7
18
7b
22
21
24
25
10

FUEL INJECTION VALVE FOR INTERNAL COMBUSTION ENGINES

PRIOR ART

The invention is based on a fuel injection valve for internal combustion engines according to the preamble to claim 1. A fuel injection valve of this kind has been disclosed by the published, non-examined German patent disclosure DE-OS 2 303 506. The fuel injection valve has an associated valve body which can be comprised of a number of parts. The valve body tapers toward the combustion chamber so that at least one annular shoulder is embodied on its circumference surface and rests against a contact surface embodied in the receiving bore. The valve holding body has an annular groove embodied on it, in which a support element is disposed, which is embodied as a snap ring that is open in at least one location on its circumference. The snap ring is dimensioned so that it protrudes with approximately half of its thickness beyond the valve holding body. At the end of the receiving bore remote from the combustion chamber, there is a clamping element embodied as a union nut which encompasses the valve holding body and, with its external thread, engages in an internal thread embodied on the circumference surface of the receiving bore. At the end of the union nut oriented toward the contact surface, there is a hollow embodied on the inside, which covers over the snap ring. As a result, the union nut is supported against the valve holding body by means of the snap ring and can therefore clamp the valve body with the annular shoulder against the contact surface. Due to a tapered design of the hollow in the union nut, when being clamped in the axial direction, the snap ring is pressed radially against the valve holding body so that the snap ring securely engages the valve holding body. The relatively deep annular groove containing the snap ring represents a weakening of the valve holding body because of the excess stresses brought about by the stress concentration. As regards future fuel injection valves with even higher injection pressures than are currently customary, strength problems can therefore arise in the vicinity of the annular groove. Due to the circular cross section of the snap ring, essentially a linear contact occurs when it is clamped radially against the valve holding body, which leads to high surface pressures and therefore to an additional weakening in this area.

ADVANTAGES OF THE INVENTION

The fuel injection valve for internal combustion engines according to the invention, with the characterizing features of claim 1, has the advantage over the prior art that due to the support element having a cylindrical surface on its inner circumference, when it is radially clamped against the valve holding body, there is a larger contact surface, which permits there to be a low surface pressure. In an embodiment according to the dependent claims 2 to 6, the outer circumference surface of the support element and the inner circumference surface of the clamping element are embodied conically, as a result of which during clamping, a radial force is exerted on the support element, which is embodied as radially elastic. The surface with which the support element contacts the valve holding body can be embodied as very large so that the surface pressure required for fixing the valve holding body turns out to be correspondingly low.

In order to dispose the support element in a definite position in relation to the valve holding body, it is useful to dispose it in an annular groove according to the dependent claims 7 and 8. As a result of the large contact surface of the support element, a depth of the annular groove of a few tenths of a millimeter is sufficient, wherein the annular groove is used essentially to fix the position of the support element before installation of the fuel injection valve in the internal combustion engine. The force transfer in the axial direction takes place by means of the force that can be transferred by means of the conically extending circumference surface with adhesion of the support element on the valve holding body produced by the contact pressure. Due to the only slight narrowing of the wall region by the flat annular groove, there is only a very slight weakening of the valve holding body in this region so that the valve holding body can withstand significantly higher injection pressures. Moreover, it is not necessary to harden the region of the annular groove in the valve holding body in a separate, costly process of the kind that is required when clamping with the aid of a snap ring and the annular groove can be produced at the end of the manufacturing process by means of a simple and inexpensive turning process.

DRAWINGS

An exemplary embodiment of the invention is represented in the drawings and will be explained in detail in the subsequent description.

Figure 2:
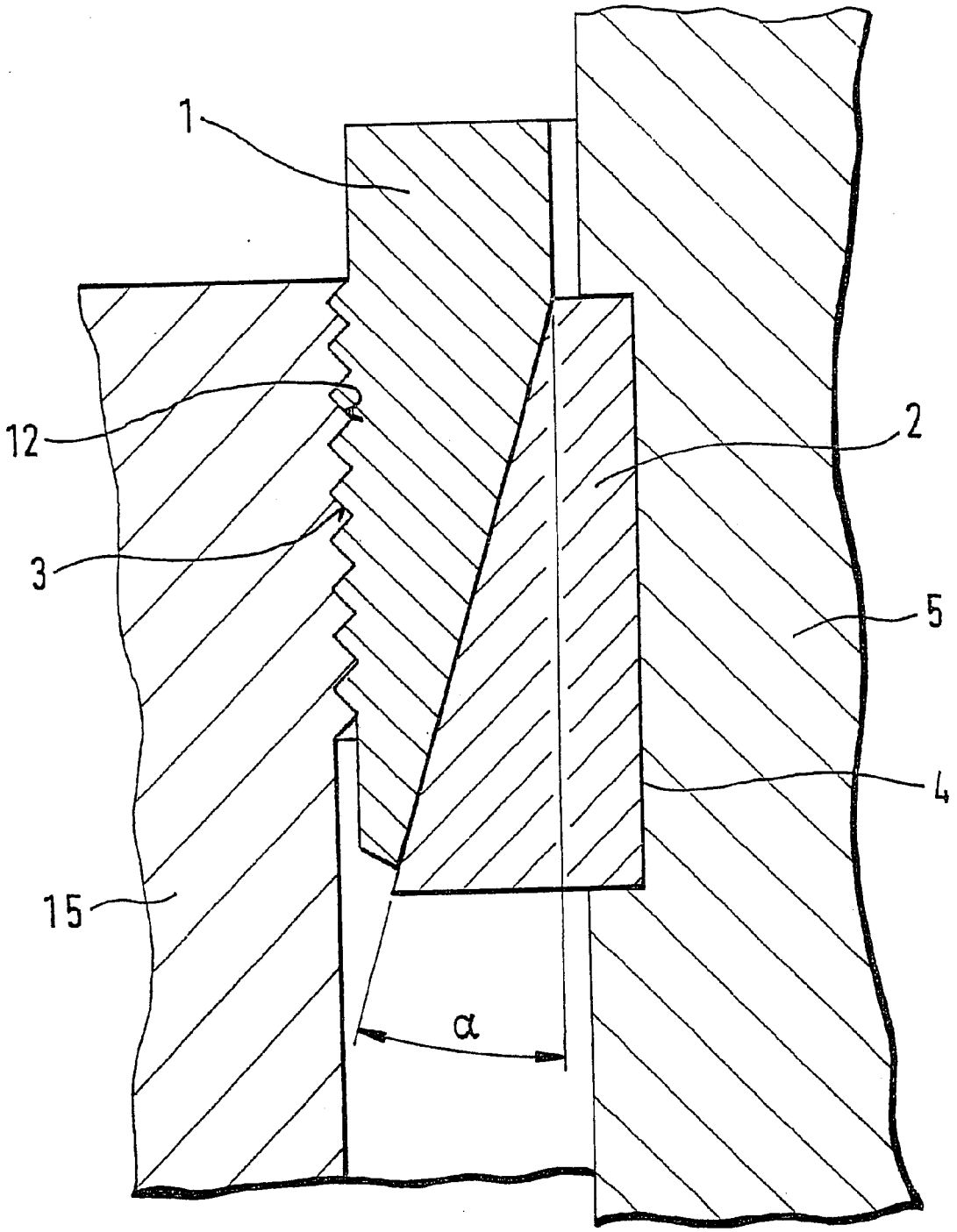
Figure 3:
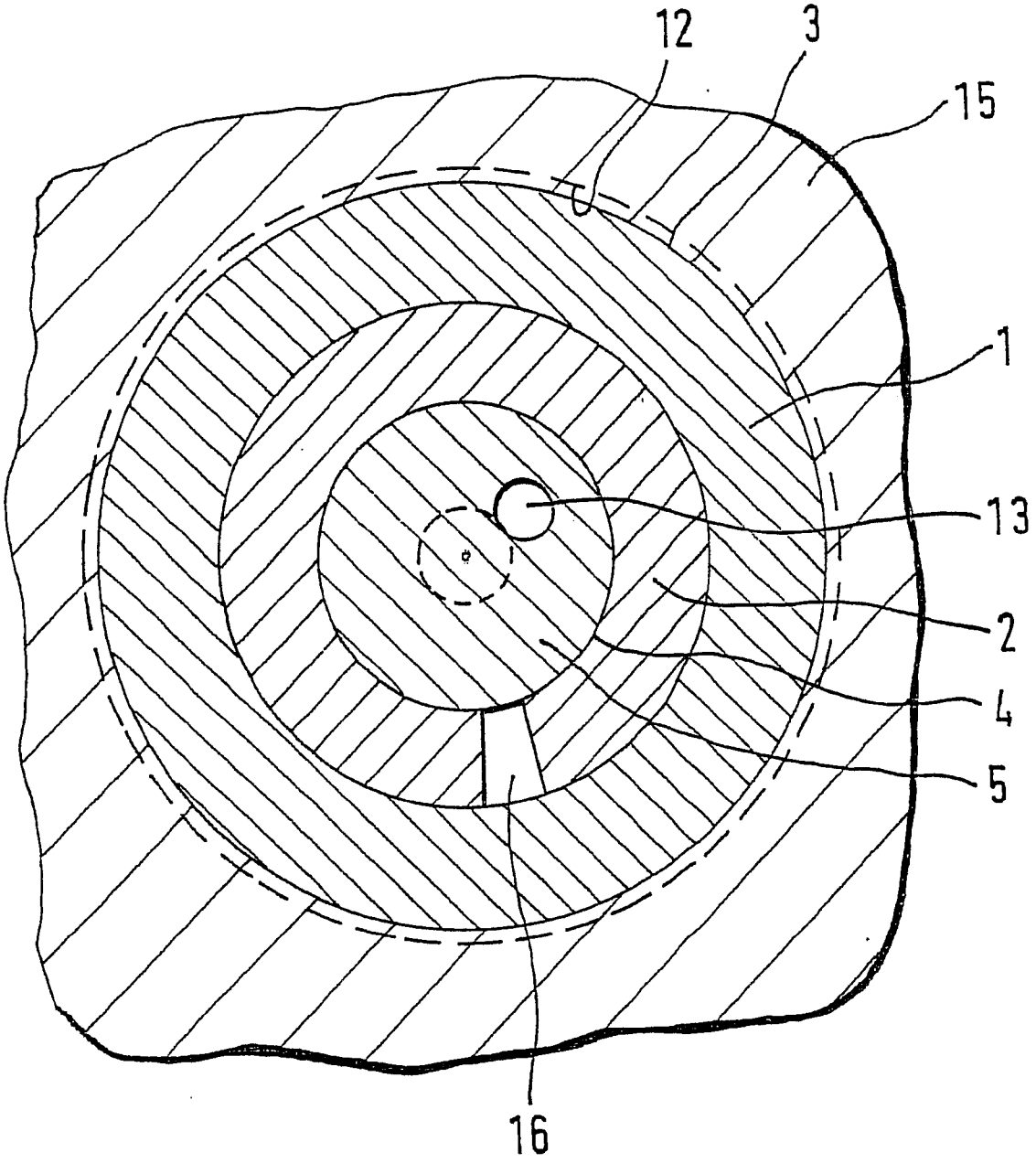

FIG. 1 is a view of a fuel injection valve with a clamping element and support element in the installation position in the receiving bore of the housing of an internal combustion engine, FIG. 2 shows an enlarged detail from FIG. 1 in the vicinity of the clamping element, and FIG. 3 is an enlarged cross section along the line III—III in FIG. 1.

DESCRIPTION OF THE EXEMPLARY EMBODIMENT

FIG. 1 shows a full view of a fuel injection valve according to the invention and its installation in the internal combustion engine. The following description is limited to the parts of the fuel injection valve that are essential to the invention.

The valve body 30 is comprised of a cylindrical valve holding body 5 and a valve base body 7, wherein the valve base body 7 is clamped against the valve holding body 5 by means of a clamping sleeve 8, with the interposition of an intermediary washer 6. The valve base body 7 is divided into two cylindrical sections, wherein the section 7a oriented toward the valve holding body 7 is embodied with a larger diameter than the section 7*b* remote from the valve holding body 5. The valve base body 7 has a bore 21 embodied in it which contains a piston-shaped, axially movable valve member 22. The closing force of at least one spring 27, which is disposed in a spring chamber 26 embodied in the valve holding body 5, presses the valve member 22 against a valve seat 24 that closes the bore 21 to the combustion chamber. The valve member 22 cooperates with the valve seat 24 in such a way that the axial movement of the valve member 22 permits an opening and closing of at least one injection opening 25 embodied on the valve seat 24. In the valve holding body 5, the intermediary washer 6, and the valve base body 7, there is a supply conduit 13 which can be connected at its one end to a high-pressure fuel pump by means of a high-pressure supply line that is not shown. The supply conduit 13 feeds into a pressure chamber 23 where, because the fuel introduced into the supply conduit 13 acts on a pressure shoulder 28 embodied on the valve member 22, the valve member 22 is subjected to a force that acts in the axial direction. If this force exceeds the closing force of the spring 27, then the valve member 22 lifts up from the valve seat 24 and fuel is injected into the combustion chamber.

The valve body 30 is disposed in a receiving bore 9, 10 in the housing 15 of an internal combustion engine. The receiving bore 9, 10 is divided into a part with a larger diameter 9, which is remote from the combustion chamber, and a part with a smaller diameter 10, which is disposed oriented toward the combustion chamber end. A contact surface 18 is embodied at the transition between the two parts of the receiving bore 9, 10, and an internal thread 12 is embodied at the end of the receiving bore 9 remote from the combustion chamber. A transition from the clamping sleeve 8 to the valve base body 7 produces an annular shoulder 17, which comes into contact with the contact surface 18 embodied in the receiving bore 9, 10. A seal 11 is placed between the annular shoulder 17 and the contact surface 18 and seals the combustion chamber in relation to the larger diameter part of the receiving bore 9.

On the circumference surface of the valve holding body 5, there is an annular groove 4 which extends over the entire circumference of the valve holding body 5. A support element 2 is disposed in the vicinity of the annular groove 4 and is accommodated for a part of its thickness into the annular groove 4. The support element 2 is split at a point on its circumference, which lends it radial flexibility, and is made of an elastic material, for example a steel. Due to the cylindrical embodiment of the inner circumference surface of the support element 2, it rests with its entire surface against the circumference surface of the annular groove 4. The outer circumference surface of the support element 2 is conically embodied, wherein the vertex of the cone that constitutes the conical outer circumference surface points away from the combustion chamber. This produces an at least approximately trapezoidal cross section of the support element 2. The end of the receiving bore 9 remote from the combustion chamber has a sleeve-shaped clamping element 1 disposed in it whose outer circumference surface has an external thread 3 embodied on it with which the clamping element 1 is screwed into an internal thread 12 embodied on the inside of the receiving bore 9. The clamping element 1 encompasses the support element 2, wherein the inner circumference surface of the clamping element 1 is embodied conically and the vertex of the cone that constitutes this conical surface points away from the contact surface 18. The cone angle $\alpha$ of the inner circumference of the clamping element 1 and that of the outer circumference surface of the support element 2 are at least approximately equal so that the support element 2 contacts approximately the entire circumference surface of the clamping element 1. The provision can also be made that the two cone angles are not precisely equal and that only after the clamping element 1 has been clamped is an extensive contact surface produced between the clamping element 1 and support element 2.

By screwing the clamping element 1 into the internal thread 12 of the receiving bore 9, the clamping element 1 is moved axially into the receiving bore 9 in the direction of the combustion chamber, which brings the clamping element 1 into contact with the support element 2. The support element 2 is thus brought into contact with the boundary of the annular groove 4 that is closer to the combustion chamber. With further movement of the clamping element 1 toward the combustion chamber, the conical inner circumference surface of the clamping element 1 slides against the likewise conical outer circumference surface of the support element 2. In accordance with the cone angle, the force exerted by the clamping element onto the support element 2 is divided into an inwardly directed radial force and an axial force oriented toward the combustion chamber. Due to the radial force on the support element 2, the maximal static friction force between the support element 2 and the valve holding body 5 increases until it is greater than the axial force on the valve holding body 5 required to clamp the valve body 30 against the contact surface 18. The cone angle is between 5 and 45 degrees, preferably approximately 10 degrees.

The axial clamping of the valve holding body 5 by the clamping element 1 and the support element 2 therefore does not occur because the support element 2 catches on the lower boundary of the annular groove 4, but only as a result of the static friction force between the support element 2 and the valve holding body 5. The annular groove 4 is only used to definitely position the support element 2 in a particular section of the valve holding body 5 so that the annular groove 4 can also be eliminated if this should be advantageous.

On an enlarged detail from FIG. 1, FIG. 2 shows the disposition of the support element 2 and the clamping element 1. In this exemplary embodiment, the cross-sectional surface of the clamping element 2 is embodied as trapezoidal, wherein the parallel sides of the trapezoid extend perpendicular to the circumference surface of the valve holding body 5. The annular groove 4 has a rectangular cross section so that the support element 2 is disposed in a definite position in relation to the valve holding body 5 and, because of its flexible embodiment, snaps into the annular groove 4 during installation.

The conical embodiment of the outer circumference surface of the support element 2 and the inner circumference surface of the clamping element 1 is not absolutely necessary in order to achieve a transmission of a force, which is exerted by the clamping element 1 onto the valve holding body 5, in both the axial and radial directions. Other exemplary embodiments are also possible in which a curved inner circumference surface of the clamping element 1 and a similarly or differently curved outer circumference surface of the support element 2 likewise achieve a transmission of radial and axial force onto the support element 2 and the valve holding body 5.

The provision can also be made that the clamping element 1 is clamped against the supporting element 2 not by means of a thread but by means of a claw or another clamping device. In this instance, both the external thread 3 of the clamping element 1 and the internal thread 12 of the receiving bore 9 can be eliminated.

What is claimed is:

1. In a fuel injection valve for internal combustion engines, having an associated valve body (30), which is inserted into a receiving bore (9, 10) of a housing of the internal combustion engine (15) and with an end region, protrudes into a combustion chamber of the engine, wherein disposed lateral to its longitudinal axis and oriented toward the combustion chamber, the valve body (30) has an annular shoulder (17) with which it comes into contact with a contact surface (18) remote from the combustion chamber, inside the receiving bore (9, 10), and having a sleeve-shaped clamping element (1) disposed on the valve body (30) and a radially elastic, partially annular support element (2) disposed on the valve body (30), which support element (2) is at least partially encompassed by the clamping element (1), wherein by means of the clamping force that it transmits onto the support element (2) in the direction of the longitudinal axis of the valve body (30) toward the contact surface (18), the clamping element (1) presses the support element (2) radially inward against the valve body (30) and, by means of the support element (2), the clamping force presses the valve body (30) against the contact surface (18), the improvement wherein on its inner circumference surface with which it is pressed radially against the valve body (30) by the clamping element (1), the support element (2) has an at least approximately cylindrical surface.

2. The fuel injection valve for internal combustion engines according to claim 1, wherein on its outer circumference, the support element (2) tapers in the direction away from the contact surface (18).

3. The fuel injection valve for internal combustion engines according to claim 1, wherein in the vicinity of the support element (2), the inner circumference surface of the clamping element (1) tapers in the direction away from the contact surface (18).

4. The fuel injection valve for internal combustion engines according to claim 2, wherein the outer circumference of the support element (2) and the inner circumference of the clamping element (1) are embodied as at least approximately conical.

5. The fuel injection valve for internal combustion engines according to claim 4, wherein the cone angles a of the outer circumference of the support element (2) and of the inner circumference of the clamping element (1) are at least approximately equal.

6. The fuel injection valve for internal combustion engines according to claim 4, wherein the support element (2) is embodied as at least approximately trapezoidal in cross section.

7. The fuel injection valve for internal combustion engines according to claim 1, wherein on its outer circumference, the valve body (30) has an annular groove (4) in which the support element (2) is disposed.

8. The fuel injection valve for internal combustion engines according to claim 7, wherein the annular groove (4) has an at least approximately rectangular cross section.

9. The fuel injection valve for internal combustion engines according to claim 3, wherein the outer circumference of the support element (2) and the inner circumference of the clamping element (1) are embodied as at least approximately conical.

10. The fuel injection valve for internal combustion engines according to claim 9, wherein the cone angles a of the outer circumference of the support element (2) and of the inner circumference of the clamping element (1) are at least approximately equal.

11. The fuel injection valve for internal combustion engines according to claim 5, wherein the support element (2) is embodied as at least approximately trapezoidal in cross section.

12. The fuel injection valve for internal combustion engines according to claim 9, wherein the support element (2) is embodied as at least approximately trapezoidal in cross section.

13. The fuel injection valve for internal combustion engines according to claim 2, wherein on its outer circumference, the valve body (30) has an annular groove (4) in which the support element (2) is disposed.

14. The fuel injection valve for internal combustion engines according to claim 3, wherein on its outer circumference, the valve body (30) has an annular groove (4) in which the support element (2) is disposed.

15. The fuel injection valve for internal combustion engines according to claim 4, wherein on its outer circumference, the valve body (30) has an annular groove (4) in which the support element (2) is disposed.

16. The fuel injection valve for internal combustion engines according to claim 5, wherein on its outer circumference, the valve body (30) has an annular groove (4) in which the support element (2) is disposed.

17. The fuel injection valve for internal combustion engines according to claim 6, wherein on its outer circumference, the valve body (30) has an annular groove (4) in which the support element (2) is disposed.

18. The fuel injection valve for internal combustion engines according to claim 9, wherein on its outer circumference, the valve body (30) has an annular groove (4) in which the support element (2) is disposed.

19. The fuel injection valve for internal combustion engines according to claim 13, wherein the annular groove (4) has an at least approximately rectangular cross section.

20. The fuel injection valve for internal combustion engines according to claim 14, in the annular groove (4) has an at least approximately rectangular cross section.

* * * * *